US007248961B2

(12) United States Patent
Park et al.

(10) Patent No.: US 7,248,961 B2
(45) Date of Patent: Jul. 24, 2007

(54) METHOD FOR DETERMINING TRAFFIC CONDITIONS

(75) Inventors: Jin Ho Park, Seoul (KR); Jong Soo Lee, Seoul (KR); Woo Jin Jhong, Namyangju (KR); Hee Seok Jeong, Seoul (KR)

(73) Assignees: Hyundai Motor Company, Seocho-Ku, Seoul (KR); Kia Motors Corporation, Seocho-Ku, Seoul (KR)

( * ) Notice: Subject to any disclaimer, the term of this patent is extended or adjusted under 35 U.S.C. 154(b) by 196 days.

(21) Appl. No.: 11/021,844

(22) Filed: Dec. 22, 2004

(65) Prior Publication Data

US 2005/0143903 A1 Jun. 30, 2005

(30) Foreign Application Priority Data

Dec. 30, 2003 (KR) ..... 10-2003-0100756

(51) Int. Cl.
*G06G 7/76* (2006.01)
*G06G 7/78* (2006.01)

(52) U.S. Cl. ..... 701/117; 701/200; 342/357.09; 340/904

(58) Field of Classification Search ..... 701/117–119, 701/200, 24; 342/357.08, 357.09, 357.1; 340/988, 904–905
See application file for complete search history.

(56) References Cited

U.S. PATENT DOCUMENTS 4,812,843 A * 3/1989 Champion et al. ..... 340/905
5,214,793 A * 5/1993 Conway et al. ..... 455/500
5,862,244 A * 1/1999 Kleiner et al. ..... 382/104
2003/0097217 A1 5/2003 Wells et al.

FOREIGN PATENT DOCUMENTS

| | | |
|---|---|---|
| JP | 07-105474 | 4/1995 |
| KR | 1998-19921 | 6/1998 |
| KR | 1020010084335 | 9/2001 |
| KR | 1020020017445 | 3/2002 |
| WO | WO 02/07125 A1 | 1/2002 |

* cited by examiner

*Primary Examiner*—Y. Beaulieu
(74) *Attorney, Agent, or Firm*—Morgan Lewis & Bockius LLP

(57) ABSTRACT

A method for determining traffic conditions includes: collecting real-time traffic information of a road; calculating a representative speed value for the road by a fuzzy inference, from the collected real-time traffic information and traffic condition factors having an effect on the road; and transmitting the representative speed value to a terminal of a vehicle traveling on the road corresponding to the representative speed value. The representative speed is sensibly determined and reliable information is supplied because the fuzzy inference's performance is based on the information collected from the signal transmitter and based on the factors which can affect the traffic conditions.

1 Claim, 4 Drawing Sheets

METHOD FOR DETERMINING TRAFFIC CONDITIONS

CROSS-REFERENCE TO RELATED APPLICATIONS

This application claims priority of Korean Application No. 10-2003-0100756, filed Dec. 30, 2003, the disclosure of which is incorporated herein by reference.

FIELD OF THE INVENTION

Generally, the present invention relates to a method for analyzing traffic conditions. More particularly, the present invention relates to a method for determining or predicting traffic conditions based on collected traffic information and various traffic condition factors.

BACKGROUND OF THE INVENTION

Problems such as pollution, waste of energy, increase in traffic accidents, increase in costs, and the like, have occurred because the roads have reached its limits to manage traffic due to an incredible increase in traffic. Therefore, various methods for scattering heavy traffic are being used by collecting traffic conditions of the traveled road and providing optimal course guiding services to drivers.

For example, a navigation system loads a map from a compact disc (CD) for displaying a course to the destination or for guiding the drive with letters or sounds according to information supplied from a traffic information sensor through a wireless communication network.

In addition, in the case that the navigation system does not have a map, it receives map data of the traveled region through wireless communication with GPS, and then supplies the course guiding service using information received from an information supplying center.

As one can see, the work of collecting, analyzing, and databasing traffic information has to precede the supplying of traffic condition information to the vehicle.

The apparatus for collecting traffic information include unmanned image monitoring apparatus mounted on the roads, crossway, or the like, and loop sensors mounted on the surface of the roads, or the like. Police, reporters, and drivers also supply traffic information.

Traffic information is supplied to the driver without applying other factors such as weather, driving habit, road curvatures, and degree of slope due to limitations in the collected traffic information from the apparatuses for collecting the traffic information of the roads, the traffic warden, the reporter, and the respective driver.

Therefore, an uncertainty occurs in the traffic information supplied to the driver because traffic conditions of real roads do not apply to the information, and confidence is lowered because the traffic information supplied to the driver does not represent actual speed of the roads. In addition, the unmanned image monitoring apparatus and the loop sensors mounted on the surface of the roads, or the like, are very expensive, which presents a problem of incurring great initial costs and maintaining costs. Another problem occurs when the representative speed of a road is not supplied because there are not apparatuses for real-time collecting traffic information and a reporter for the road.

The information disclosed in this section is only to enhance of understanding of the background of the invention and should not be taken as an acknowledgement or any form of suggestion that this information serves as prior art that is already known to a person of ordinary skill in the art.

SUMMARY OF THE INVENTION

The motivation for the present invention is to provide a method for determining traffic conditions having non-limiting advantages of supplying traffic conditions.

An exemplary method for determining traffic conditions according to an embodiment of the present invention includes: collecting real-time traffic information of a road; calculating a representative speed value for the road by a fuzzy inference, from the collected real-time traffic information and traffic condition factors having an effect on the road; and transmitting the representative speed value to a terminal of a vehicle traveling on the road corresponding to the representative speed value.

In a further embodiment, the real-time traffic information comprises: information on a speed of a vehicle traveling on the road; information on a latitudinal position and a longitudinal position of the vehicle; and information on a direction that the vehicle travels.

In another further embodiment, the traffic condition factors include time and the day of the week.

In yet another embodiment, a method for predicting traffic conditions, comprises: predicting a traffic condition by a fuzzy inference from regional characteristic information and traffic condition factors having an effect on traffic conditions of the roads, in the case that real-time traffic information of the road is not collected; and transmitting the predicted traffic conditions to a terminal of a vehicle traveling on a road corresponding to the predicted traffic condition.

In another further embodiment, the regional characteristic information includes information about neighboring buildings and information on the number of lanes in the road.

BRIEF DESCRIPTION OF THE DRAWINGS

The accompanying drawings, which are incorporated herein and constitute a part of the specification, illustrate an embodiment of the invention, and, together with the description, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
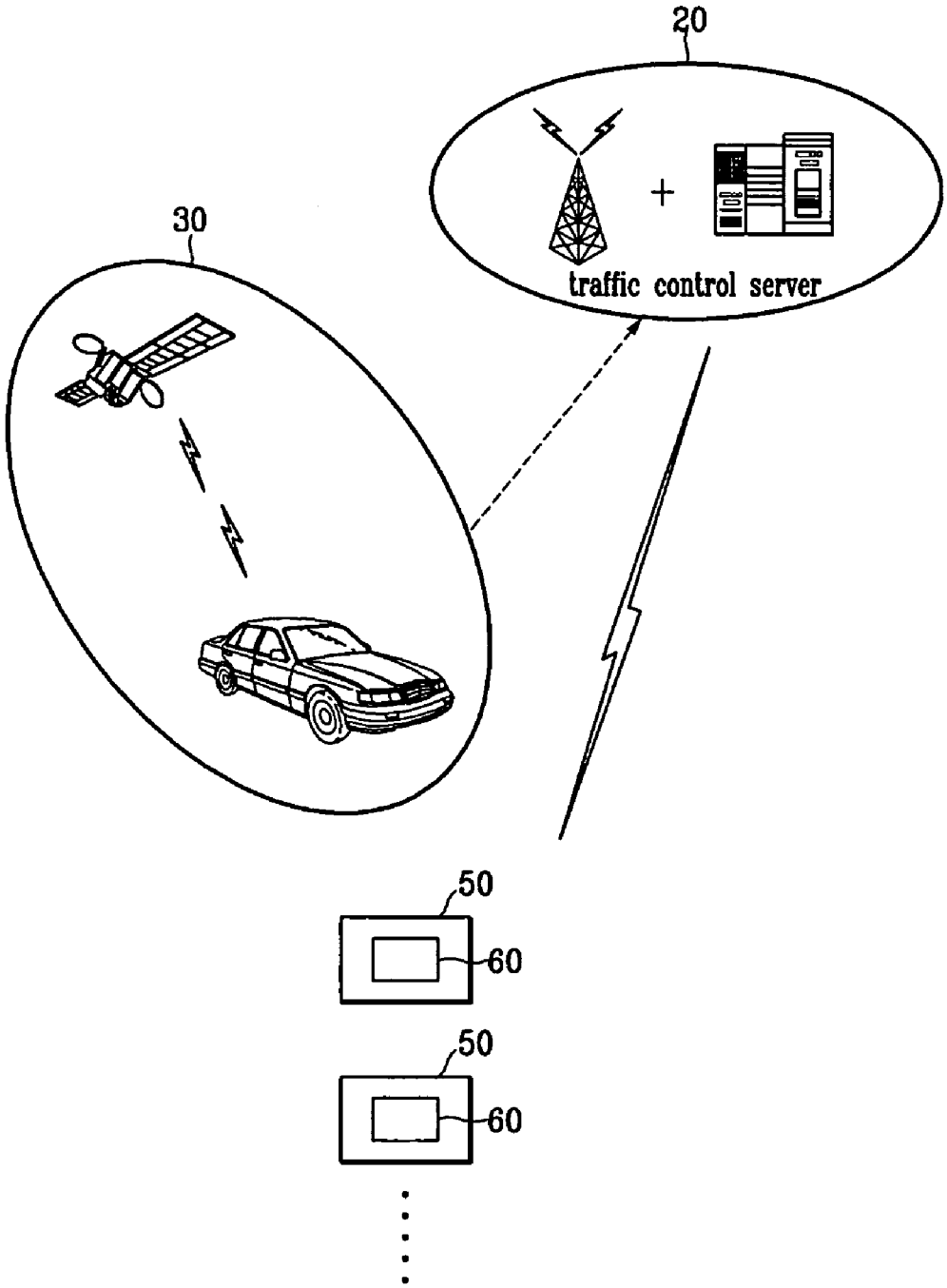
FIG. 1 is a schematic view showing a system capable of performing a method for determining traffic conditions according to an embodiment of the present invention.

FIG. 1 is a schematic view showing a road traffic information collecting system according to an embodiment of the present invention. The system that can perform a method for determining and predicting traffic conditions according to an embodiment of the present invention includes: a global positioning system (GPS) 30, which may further include a GPS signal transmitter mounted on a satellite and a GPS signal receiver mounted on a vehicle 50; a traffic control server 20 in a traffic management center; and a signal transmitter 60 mounted in the vehicle 50. The signal transmitter 60 transmits signals indicative of information for detecting a vehicle's 50 position and vehicle speed information to the traffic management server 20. The information for detecting a vehicle's 50 position may include information on the latitudinal and longitudinal position of a vehicle 50.

The traffic management server 20 receives traffic information from the signal transmitter 60 in real-time, and databases the received real-time traffic information. In addition, the traffic control server 20 calculates a representative speed value for each of the respective roads, and then transmits the representative speed value to a driver of a vehicle (i.e., a terminal in the vehicle) traveling an area (i.e., a road) corresponding to the representative speed value.

The traffic management server 20 calculates the representative speed value by a fuzzy inference, based on the traffic information collected by the signal transmitter 60, and traffic condition factors having an influence on traffic conditions of the roads. The traffic condition factors may include the day of the week, time, or the like.

Therefore, the traffic management server 20 may include an electric control unit (ECU) for operating a database system for databasing the traffic information or the representative speed value and for operating a fuzzy inference system for performing a fuzzy inference. The ECU can be realized by one or more processors activated by a predetermined program, and the predetermined program can be programmed to perform each step of a method according to an embodiment of this invention.

In addition, the traffic management server 20 may include a wireless transmitter-receiver for transmitting the traffic information or representative speed value in response to a request by the vehicle driver traveling on a road corresponding to the representative speed value. The traffic management server 20 also preferably stores various kinds of information data including news, stock information, weather information, some kinds of event information, schedule management information, information on the user's terminal, client registration information, and the like, and supplies them in response to the driver's request.

Figure 2:
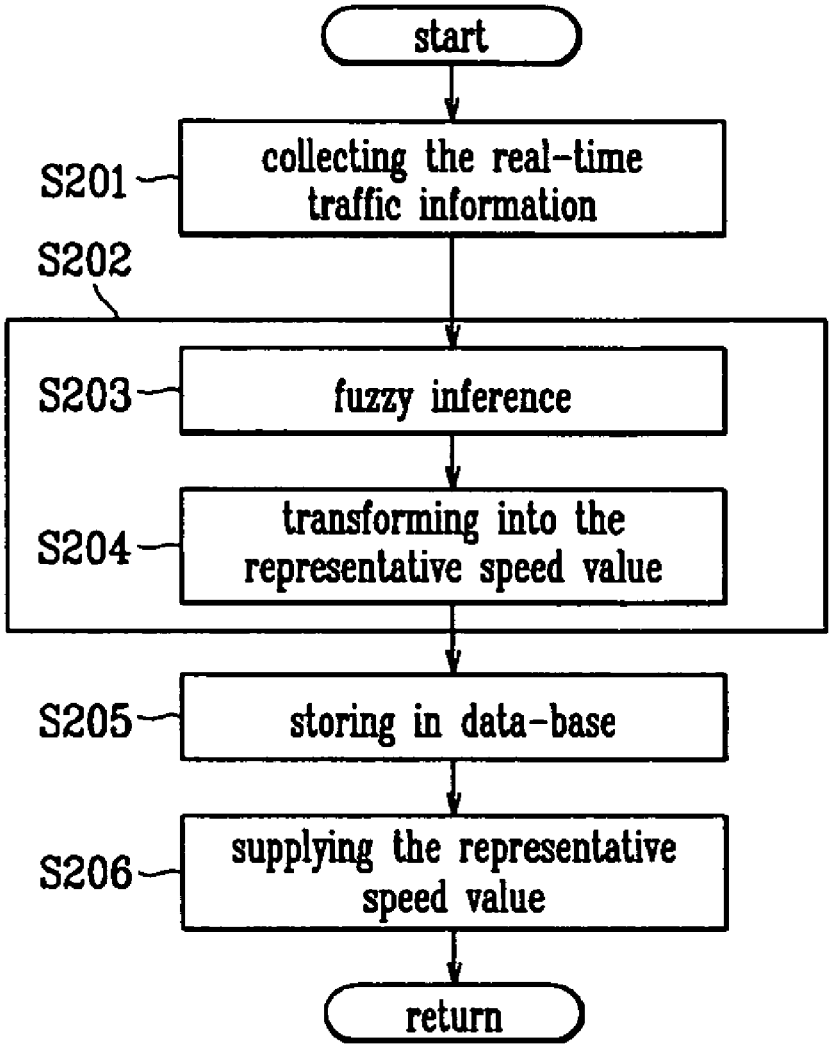
FIG. 2 is a flowchart showing a method for determining traffic conditions according to a first embodiment of the present invention.

As shown in FIG. 2, a first embodiment of the present invention is described hereinafter. At step 201, the traffic management server 20 collects real-time traffic information from the signal transmitter 60. The real-time traffic information may include: vehicle speed on respective roads; latitudinal and longitudinal position of a vehicle; and the direction in which a vehicle is traveling. The real-time traffic information is preferably stored in a database after being collected.

The ECU calculates, at step S202, a representative speed value for each of the respective roads by a fuzzy inference, based on the collected real-time traffic information and traffic condition factors having an effect on the roads. At step S203, the fuzzy inference system transforms the vehicle speed information of the respective roads into a representative speed base value indicative of a representative speed value for each road, which ranges from 0 to 1 by utilizing the traffic condition factors having an effect on the roads.

According to an embodiment of the present invention, the traffic condition factors may include the day of the week, time, and other factors having an effect on traffic conditions, such as a driver's driving habit and weather.

Figure 3:
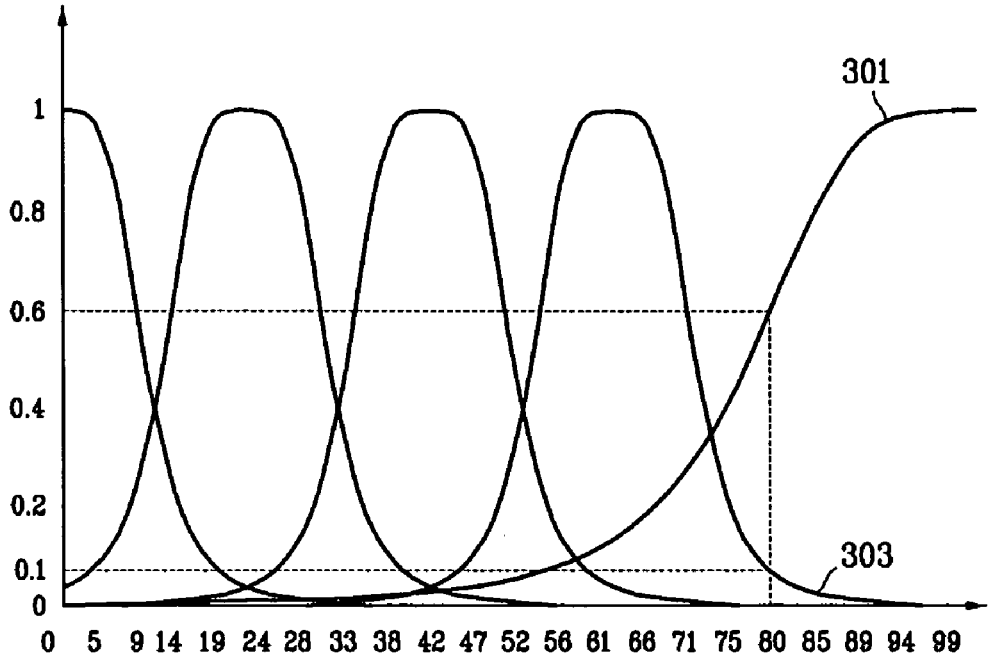
FIG. 3 illustrates fuzzy functions of a fuzzy inference for determining traffic conditions.

FIG. 3 is a drawing showing examples of fuzzy functions depending on vehicle speed for a fuzzy inference. In FIG. 3, a horizontal axis indicates a vehicle speed value, a vertical axis indicates a basic fuzzy value (i.e., a value in a fuzzy state) for calculating the fuzzy value, and curved lines indicate fuzzy functions for each traffic condition factor.

A fuzzy function is set for each traffic condition factor, so a number of the curved lines indicating the fuzzy functions are equal to that of the traffic condition factors. For example, according to an embodiment of the present invention, there would be ten fuzzy functions for seven days of the week, including Monday, Tuesday, Wednesday, Thursday, Friday, Saturday, and Sunday, and for three time intervals, including a morning rush hour, daytime, and an evening rush hour.

For example, with reference to FIG. 3, if the vehicle speed received from the signal transmitter 60 during morning rush hour on a Friday is 80, that vehicle speed 80 is converted to a first basic fuzzy function value (i.e., 0.6) by a curved line, which is designated by a reference numeral 301, indicating a fuzzy function for a Friday, and at the same time, that vehicle speed 80 is also converted to a second basic fuzzy function value (i.e., 0.1) by a curved line, which is designated by a reference numeral 303, indicating a fuzzy function for the morning rush hour.

The representative speed base value, which is a crisp value, may be calculated on the basis of the first and second basic fuzzy function values by a defuzzification method. The defuzzification method, which is used in the fuzzy inference, is for transforming two or more numbers into one fixed number. The defuzzification is a method for transforming two or more values in a fuzzy state into one crisp value, and one example of the defuzzification method is a centroid of area (COA) method.

Subsequently, at step S204, the calculated representative speed base value is transformed into the representative speed value. For example, the representative base speed value can be transformed into the representative speed value by using a predetermined table that includes representative speed data set with respect to representative base speed values.

Then, at step S205, the representative speed value is stored in the database as the representative speed value of the corresponding road where the traffic information was collected.

If a representative speed value is requested by the vehicle's driver, the representative speed value is supplied to the vehicle's driver by the wireless transmitter-receiver of the traffic management server 20 at step S206.

At the step S206, the representative speed value can be supplied as another type of value besides speed value when the representative speed value is supplied. For example, if the representative speed value output at the step S204 is 20 Km/h, the representative speed value can be transformed into a literal data indicating a current traffic condition such as "traffic condition congestion" by the ECU, and the transformed literal data can be transmitted to the vehicle driver.

As described above, according to an embodiment of the present invention, the method for determining traffic conditions can supply more exact and confident information than that of the prior art because factors including the day of the week and the time are applied.

In addition, because the information used in the method for determining traffic conditions is collected only from the signal transmitter 60, great initial costs and maintenance costs can be reduced, which are conventionally spent for installing and maintaining very expensive apparatuses, including an unmanned image monitoring apparatus and loop sensors mounted on a surface of the roads, or the like.

Figure 4:
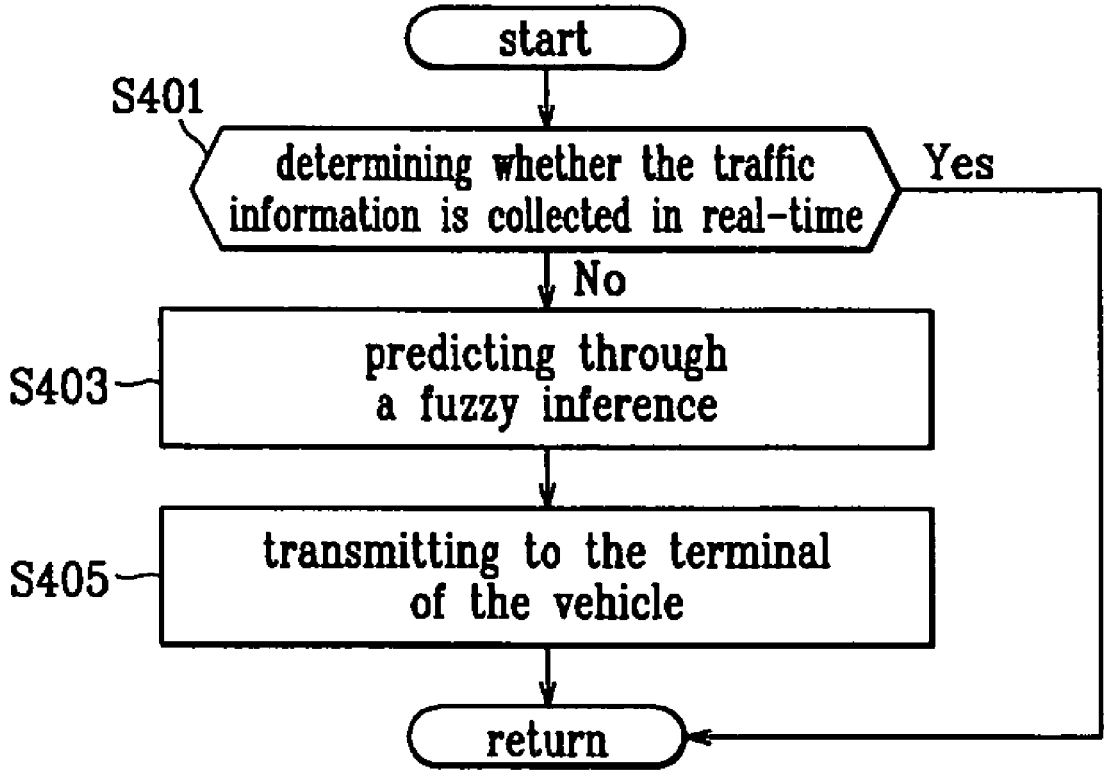
FIG. 4 is a flowchart showing a method for predicting traffic conditions according to a second embodiment of the present invention.

FIG. 4 is a flowchart showing a method for predicting traffic conditions according to a second embodiment of the present invention. The second embodiment of the present invention is a method for predicting traffic conditions on a road in a region that real-time traffic information cannot be received by the signal transmitter 60. Referring to FIG. 4, the method will be described hereinafter.

At step 401, if traffic condition information is requested by the vehicle's driver (i.e., a terminal of the vehicle) traveling in a specific region, the ECU determines whether the traffic information is collected in real-time. If the traffic information is collected in real-time, the method for determining traffic conditions according to the first embodiment of the present invention is performed.

If the traffic information is not collected in real-time, a traffic condition is, at step 403, predicted through a fuzzy inference, on the basis of regional characteristic information and traffic condition factors having an influence on traffic conditions. As stated above, the traffic condition factors may include the day of the week, time, and other factors having an effect on traffic conditions such as a driver's driving habit and weather.

The regional characteristic information may include information on buildings around the roads, information on the number of lanes in the road, and other information reflecting regional characteristics. The information on buildings is a factor for indicating how many vehicles may come to the road from the buildings near it while the method for predicting traffic conditions is being performed. The information on buildings may include information indicating that a corresponding region is a commercial area, information indicating that a corresponding region is a residential area, or other information indicating the type of the information on the number of lanes in the road is information regarding a maximum traffic amount that the road can accommodate.

More particularly, if the traffic information is not received in real-time, the traffic condition is predicted by fuzzy functions for regional characteristic information and for each traffic condition factor. For example, the fuzzy functions can be realized by an if-then rule that is one of fuzzy inference methods. A specific result may be obtained through the "if-then" rule from linguistic information. One example of the if-then rule may be that the traffic condition is in a congested state if the day of the week is Friday, the time is morning rush hour, and the regional information indicates a commercial area. Another example may be that the traffic condition is light if the day of the week is Friday, the time is two o'clock in the afternoon, and the regional information indicates a residential area. Such if-then rules are applied to each of the regional characteristic information and the traffic condition factors.

The predicted traffic conditions such as traffic congestion, light traffic, and the like, are transmitted to the terminal of the vehicle traveling in the specific region at step S405.

According to an embodiment of the present invention, the representative speed is sensibly determined and reliable information is supplied because the fuzzy inference is performed based on the information collected from the signal transmitter 60 and based on the factors which can affect the traffic conditions.

In addition, because the traffic conditions are predicted on the basis of the regional information and the traffic condition factors when real-time traffic information cannot be received, reliable traffic information can also be obtained.

While the foregoing description represent various embodiments of the present invention, it will be appreciated that the foregoing description should not be deemed limiting since additions, variations, modifications and substitutions may be made without departing from the spirit and scope of the present invention. It will be clear to one of skill in the art that the present invention may be embodied in other forms, structures, arrangements, and proportions and may use other elements, materials and components. The present disclosed embodiments are, therefore, to be considered in all respects as illustrative and not restrictive, the scope of the invention being indicated by the appended claims and not limited to the foregoing description.

What is claimed is:

1. A method for predicting traffic conditions, comprising:

predicting a traffic condition by a fuzzy inference from regional characteristic information and traffic condition factors having an effect on the roads, in the case that real-time traffic information of the roads is not collected; and transmitting the predicted traffic condition to a terminal of a vehicle traveling on a road corresponding to the predicted traffic condition;

wherein the regional characteristic information includes a first information about neighboring buildings and a second information on the number of lanes in the road.

* * * * *